United States Patent [19]

Ikeya

[11] 4,083,182

[45] Apr. 11, 1978

[54] MANIFOLD REACTOR

[75] Inventor: Taro Ikeya, Toyota, Japan

[73] Assignee: Toyota Jidosha Kogyo Kabushiki Kaisha, Toyota, Japan

[21] Appl. No.: 706,960

[22] Filed: Jul. 20, 1976

[30] Foreign Application Priority Data

Dec. 29, 1975 Japan ..... 50-156549

[51] Int. Cl.[2] ..... F01N 3/10

[52] U.S. Cl. ..... 60/282; 60/322; 60/323

[58] Field of Search ..... 60/282, 322, 323

[56] References Cited

U.S. PATENT DOCUMENTS

| | | | |
|---|---|---|---|
| 2,678,529 | 5/1954 | Buchi | 60/322 |
| 3,302,394 | 2/1967 | Pahnke | 60/282 |
| 3,703,083 | 11/1972 | Tadokoro | 60/322 |
| 3,990,234 | 11/1976 | Kajitani | 60/282 |
| 3,994,271 | 11/1976 | Ishizuya | 60/322 |

*Primary Examiner*—Douglas Hart

[57] ABSTRACT

A manifold reactor used for the purpose of cleaning the exhaust gas emitted from an automobile or any other internal combustion engine-driven vehicle, which is constituted of three shells, i.e, an inner shell or baffle, an intermediate shell and an outer shell. The construction of said manifold reactor allows the inner shell and the intermediate shell to freely expand or contract in any direction in relation to the outer shell by virtue of a suspension structure with a suspension bolt that fixes the inner shell and the intermediate shell in a central place within the outer shell thus avoiding thermal stress due to heat of the exhaust gas.

5 Claims, 2 Drawing Figures

MANIFOLD REACTOR

BACKGROUND OF THE INVENTION

1. Field of the Invention

The present invention relates to the construction of a manifold reactor constituting an engine exhaust cleansing apparatus for an automobile and other internal combustion engine-driven vehicles and, more specifically, relates to the construction of such a manifold reactor of a triple construction system comprising an inner shell or baffle, an intermediate shell and an outer shell, whereby the inner shell and the intermediate shell are so designed as to be capable of being subjected to expansion and contraction freely enough in any direction, in relation to the outer shell, by means of a suspension bolt that fixes the inner shell and the intermediate shell in place specifically selected as the center thereof.

2. Description of Prior Art

In general, a manifold reactor is an apparatus of such a category as is provided with a lagging reaction chamber for removing HC and CO contained in an exhaust gas emitted from an internal combustion engine by the application of high-temperature oxidative reaction that results from making use of heat energy held in the exhaust gas itself, and is usually fitted in place in lieu of an exhaust manifold for the purpose of retaining high temperature, thus being termed a manifold reactor, And, usually a double construction system or a triple construction system is adopted for the purpose of elevating the performance of the said high-temperature oxidative reaction; besides, suitable heat insulating material is incorporated therein for the purpose of constituting a heat barrier and a heat shield. It the case of the manifold reactor, the inner body of the shell thereof coming in contact with a high-temperature gas is subjected to expansion and contraction by virtue of heat. It is desirable for a manifold reactor of the triple construction system, for instance, that the inner shell and the intermediate shell thereof have such a construction that is well capable of being subjected to expansion and contraction by heat in any direction freely enough in the relation thereof to the outer shell thereof, in terms of being kept free from deformation by thermal strain; however, none have thus far proved to be satisfactory enough to meet the said requirement.

SUMMARY OF THE INVENTION

Under such a situation, the present invention is specifically made in an effort to provide such a manifold reactor of a new and novel construction system that, in a manifold reactor of the triple construction system comprising an inner shell or baffle, an intermediate shell and an outer shell, the inner shell and the intermediate shell can be expanded and contracted freely enough in any direction by virtue of heat, in relation to the outer shell, using a suspension bolt for fixing and suspending the said shells properly in place specifically selected as the center thereof. Furthermore, in the case of the present invention, the inner shell of the manifold reactor is properly retained in place on the intermediate shell such that it is free to be expanded and contracted in relation to the intermediate shell, and, in addition thereto, the intermediate shell is properly retained in place by means of an intermediate shell retainer plate in relation to the outer shell, whereby such a manifold reactor of which the said retainer plate is so designed as to absorb the expansion and the contraction of the intermediate shell by heat can be obtained. The manifold reactor of this invention provides a new and novel construction system wherein thermal strain is caused to take shape only locally.

To put it otherwise, the subject matter of the present invention lies in introducing such a construction of a manifold reactor as features that, in such a manifold reactor specifically designed for cleansing an exhaust emitted out of an internal combustion engine as is of the triple construction system comprising an inner shell, an intermediate shell and an outer shell, the intermediate shell and the inner shell are respectively suspended virtually concentrically from, and fixed in place on, a suspension bolt fixed and fitted on the top of the outer shell, and an exhaust path so formed as to run from the inlet of the said manifold reactor is properly arranged in a spiral manner between the inner shell and the intermediate shell by the said inner shell and the said intermediate shell. Furthermore, the said exhaust path is so formed as to reach an outlet by running through the said intermediate shell and the said outer shell, and introducing such a construction of a manifold reactor as features that, in the said manifold reactor set forth in paragraph 1 above, the space between the outer shell and the intermediate shell is filled with suitable heat insulating material.

Other purposes and the effects of the present invention will be self-evident in view of an illustration of the present invention.

DETAILED DESCRIPTION OF THE INVENTION

Figure 1:
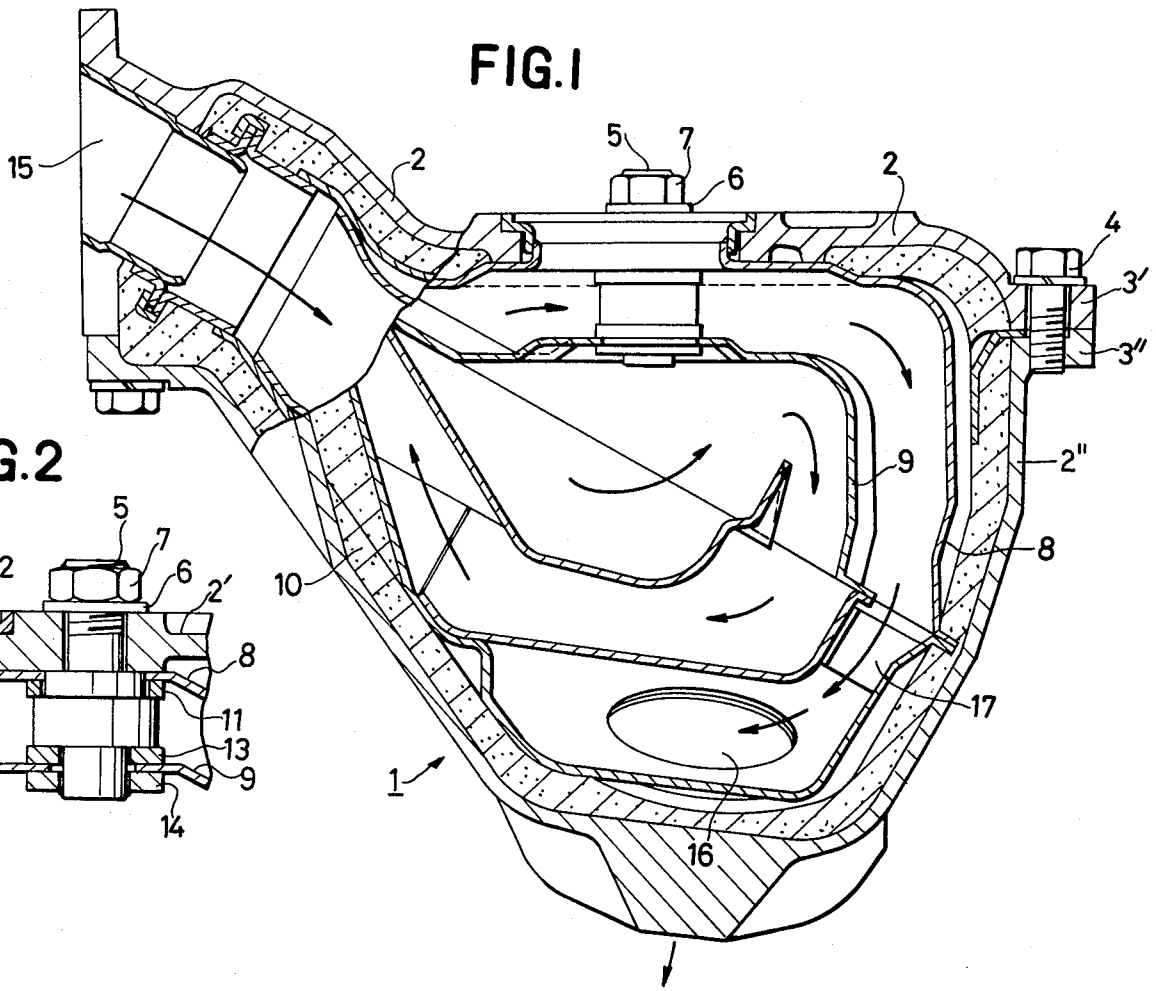
FIG. 1 is a sectional drawing of one embodiment of the present invention.
Figure 2:
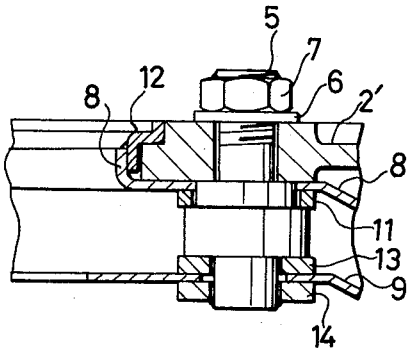
FIG. 2 is a detailed sectional drawing of the vicinity of the suspension bolt 5 shown in FIG. 1.

A description of the present invention will be given below by making reference to an embodiment thereof shown in the drawing attached hereto. FIG. 1 is a sectional drawing of one embodiment of the present invention. A manifold reactor 1, into which an exhaust emitted out of a gasoline engine is led, has such an outer shell 2 that is connected with a cylinder head (not shown in the drawing) contained therein. The said outer shell 2 comprises an upper outer shell 2' and a lower outer shell 2''. And flanges 3', 3'' fitted in place on the said upper outer shell 2' and the said lower outer shell 2'', respectively, are tied and bonded by means of a tie bolt 4, in forming the said manifold reactor 1. A suspension bolt 5 is fixed in place running through the upper outer shell 2', and the top thereof has a nut 7 screwed and tightened thereon with the upper outer shell 2' and a washer 6 interposed in between. The said suspension bolt 5 has an intermediate shell 8 and an inner shell 9 suspended therefrom. And the space between the outer shell 2 and the intermediate shell 8 is filled with heat insulating material 10. With regard to the said suspension bolt 5, another one is arranged in place in the direction intersecting at right angles with what is shown in this drawing, in the case of this embodiment. FIG. 2 is a sectional drawing to show the vicinity of the suspension bolt 5 shown in FIG. 1. The top surface of the intermediate shell 8 in the vicinity of the suspension bolt 5 is caused to come in pressure contact with the bottom surface of the upper outer shell 2' by means of a retainer plate 11. A seal ring 12 is arranged in place for the purpose of hermetically sealing the space formed between the intermediate shell 8 and the vicinity of the section for the suspension bolt to run through the outer shell 2'. And a couple of retainer plates 13, 14 are arranged in place at the lower section of the suspension bolt 5 in a manner of vertically interposing the said inner shell 9 in the vicinity of the suspending section of the inner shell for the purpose of suspending the inner shell 9 down to the lower section of the said suspension bolt, and, of the said couple of retainer plates 13, 14, only 14 alone is fixed and fitted in place on the lower end of the said suspension bolt. The exhaust to be discharged through the exhaust valve of the cylinder head of the engine is led into the inner shell 9 in the manifold reactor 1 from the inlet 15 formed in the upper left portion of the manifold reactor, and in the wake thereof, is led out into the exhaust system arranged outside the manifold reactor from the outlet 16 of the manifold reactor at the final stage, as shown by an arrow in FIG. 1, after turning clockwise along the passage bearing the mark of an arrow and arranged between the inner shell 9 and the intermediate shell 8. In the drawing, 17 is a retainer plate for the inner shell 9, arranged in place in the center of the manifold reactor, and, in case the inner shell is subjected to expansion or contraction, the inner shell is properly expanded or contracted around the retainer plate. Besides, it is recommended, as one example, that the length of the flow channel for an exhaust gas be so selected as to be 0.3 – 0.6m, and the volume of the flow channel be 1 – 1.5 times as much the exhaust to be discharged out of the engine.

As set forth in detail in the preceding paragraphs, in the case of the present invention, the intermediate shell and the inner shell of the manifold reactor of the triple construction system are concentrically suspended from the outer shell by means of a bolt; therefore, in case the inner shell and the intermediate shell are subjected to expansion or contraction by virtue of heat energy, the said shells are allowed to be expanded or contracted in any direction freely enough, either forward, rearward, rightward, leftward, upward or downward, completely free from being subjected to any deflected thermal strain, whereby the manifold reactor of the present invention proves capable of being kept in a serviceable state for a long period.

It is believed the foregoing description conveys a good understanding of the objects and advantages of my invention. The appended claims have been drawn to cover all legitimate modifications and adaptations.

What is claimed is:

1. A manifold reactor for cleansing an exhaust from an internal combustion engine comprising a baffle, an intermediate shell and an outer shell, the intermediate shell and the baffle being respectively suspended from and sized in place on a suspension bolt that is fixed and fitted in place on the upper section of the outer shell, and an exhaust path is formed from an inlet of the said reactor to an outlet that is constructed outwardly of the baffle and the intermediate shell in the space formed between the baffle and the intermediate shell and runs through the said intermediate shell and the said outer shell, there being further provided a pair of retainer plates arranged in place at the middle and the lower part of said suspension bolt, respectively, in such a manner that said bolt vertically interposes and retains said intermediate shell and said baffle with said retainer plates.

2. A a manifold reactor according to claim 1 and further comprising heat insulating material filled in place in the space formed between the outer shell and the intermediate shell.

3. A manifold reactor according to claim 1 wherein the length of said flow path for exhaust gas is approximately 0.3 – 0.6m.

4. A manifold reactor according to claim 1 wherein the volume of said flow path for exhaust gas is approximately 1 – 1.5 times as much as the volume exhaust gas emitted out of the engine.

5. A manifold reactor according to claim 1 wherein said retainer plate at the lower part of said suspension bolt is rigidly secured thereto.

* * * * *